US008387973B1

(12) United States Patent
Fernández et al.

(10) Patent No.: US 8,387,973 B1
(45) Date of Patent: Mar. 5, 2013

(54) PRINT STORAGE

(75) Inventors: David Chanclón Fernández, Barcelona (ES); Ricardo Sanchis Estruch, Barcelona (ES); Joan Sanjuán Mercadal, Barcelona (ES); Emilio López Matos, Sant Cugat del Valles (ES); Xavier Alonso Becerro, Sant Cugat del Valles (ES); Ignacio De Olazábal Zugasti, Barcelona (ES); Gianni Cessel, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/408,779

(22) Filed: Feb. 29, 2012

(51) Int. Cl.
*B65H 29/54* (2006.01)

(52) U.S. Cl. ..... 271/175; 271/176

(58) Field of Classification Search ..... 271/175, 271/176, 207, 211, 220
See application file for complete search history.

(56) References Cited

U.S. PATENT DOCUMENTS

| | | | | | |
|---|---|---|---|---|---|
| 3,704,884 | A | * | 12/1972 | Nicolay et al. | 271/85 |
| 3,712,609 | A | * | 1/1973 | Robert | 271/175 |
| 3,951,264 | A | * | 4/1976 | Heidecker et al. | 206/308.3 |
| 4,272,181 | A | | 6/1981 | Treseder | |
| 4,804,174 | A | * | 2/1989 | ter Horst | 271/207 |
| 5,179,880 | A | * | 1/1993 | Sherick | 83/83 |
| 5,188,352 | A | | 2/1993 | Bartman et al. | |
| 5,190,167 | A | | 3/1993 | Andrews et al. | |
| 5,207,417 | A | * | 5/1993 | Bell et al. | 271/175 |
| 5,440,958 | A | * | 8/1995 | Terasaki et al. | 83/83 |
| 5,799,936 | A | * | 9/1998 | Sekine et al. | 271/175 |
| 5,951,005 | A | | 9/1999 | Bartman et al. | |
| 6,604,017 | B1 | | 8/2003 | Richardson et al. | |
| 2011/0063690 | A1 | | 3/2011 | Miyazaki | |
| 2011/0187038 | A1 | | 8/2011 | Heise et al. | |

FOREIGN PATENT DOCUMENTS

JP 2000072326 A 3/2000

OTHER PUBLICATIONS

Folders On-Line—RIG.805, RIGOLI FIME srl, Download date Feb. 29, 2012 <http://www.rigolifime.com/sezioni.asp?id=266>.
Tameran Surestak 600/1000 Wide Format Paper Stacker Demo.mov, Mar. 8, 2011. < http://www.youtube.com/watch?v=R6-JsMU-bWQ >.

* cited by examiner

*Primary Examiner* — David H Bollinger

(57) ABSTRACT

According to one example, there is provided a controller readable medium on which are stored controller readable instructions. The instructions are such that, when executed by a controller, perform the steps of commencing the printing of a print job on a media sheet, determining when about half of the media sheet ejected out of a printer media output is at the level of a stacker unit, activating a first array of fans to retain a portion of the ejected media sheet, completing the print job, and activating a second array of fans to blow the trailing edge of the ejected media sheet over the stacker unit.

16 Claims, 4 Drawing Sheets

PRINT STORAGE

BACKGROUND

Operating printing systems, such as industrial or large-format printing systems, in a substantially autonomously and unattended manner helps increase productivity and reduce costs for printing system operators.

To enable substantially unattended operation prints produced by such printing systems have to be stored in a satisfactory manner until collection by a printing system operator.

BRIEF DESCRIPTION

Figure 1B:
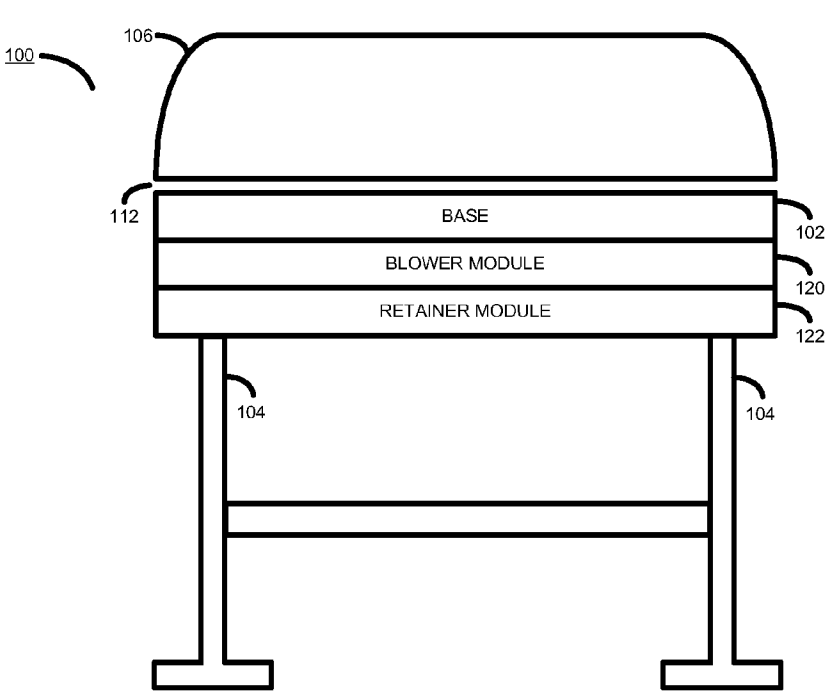
Figure 1A:
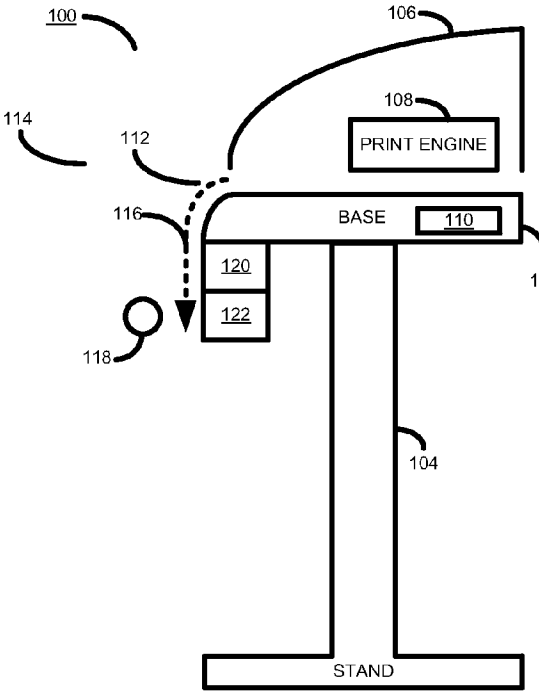
Figure 2B:
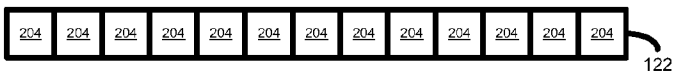
Figure 2A:
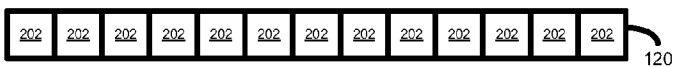
Figure 3:
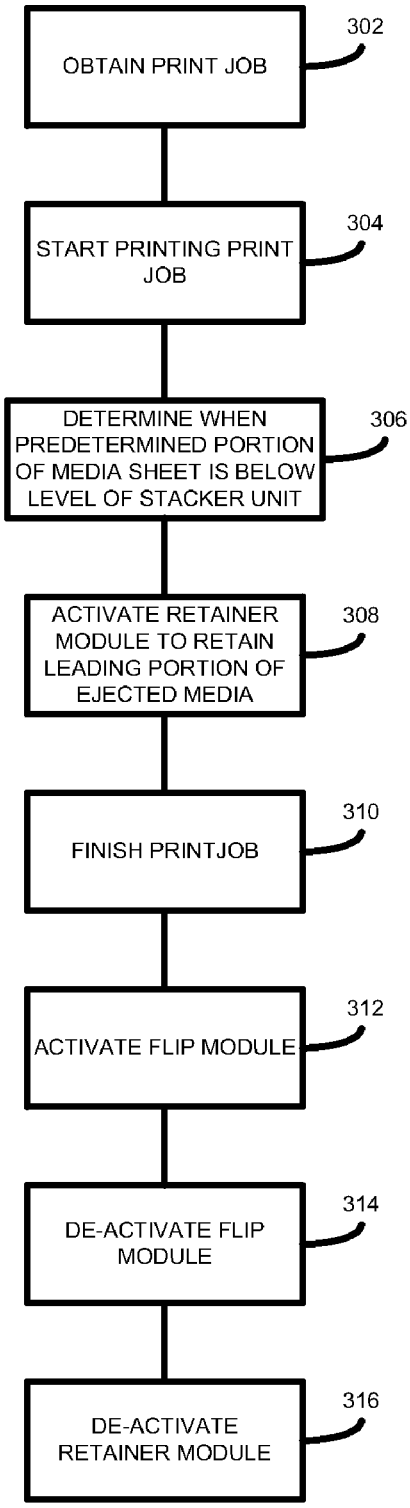
Figure 5:
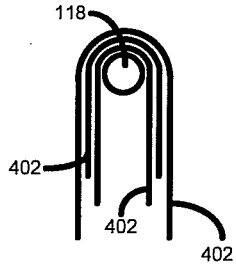
Figure 6A:
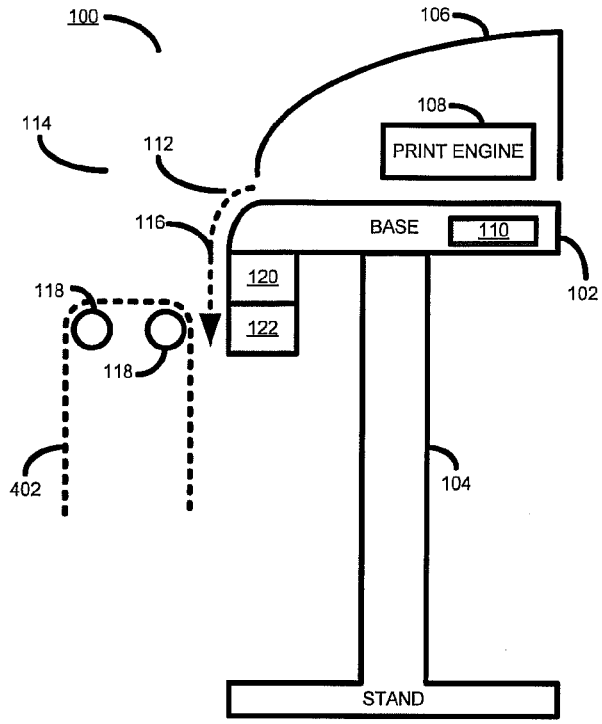
Figure 6B:
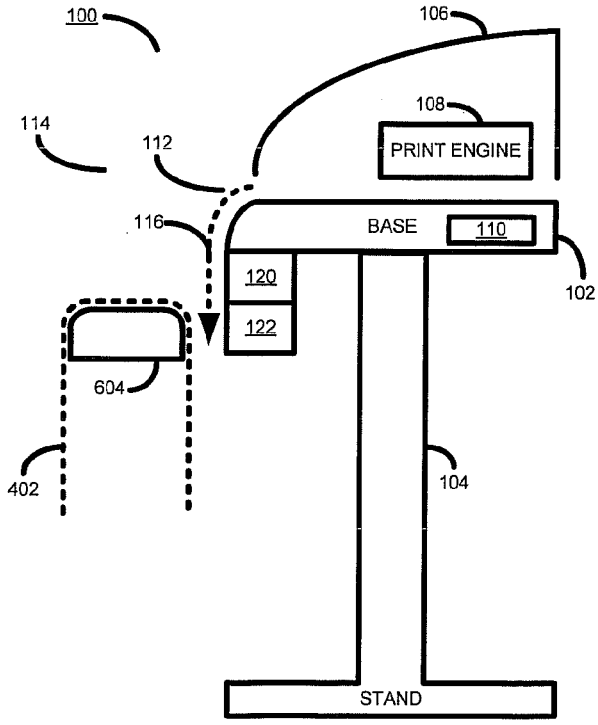

Examples, or embodiments, of the invention will now be described, by way of non-limiting example only, with reference to the accompanying drawings, in which:

FIG. 1*a* is an illustration of a side view of a printing system according to one example;

FIG. 1*b* is an illustration of a front view of a printing system according to one example;

FIG. 2*a* is an illustration of a blower unit according to one example;

FIG. 2*b* is an illustration of a retainer unit according to one example;

FIG. 3 is a flow chart outlining an example method of operating a printing system according to one example;

FIGS. 4*a* to 4*d* are illustrations of how a sheet of media is stored on a stacker unit according to one example;

FIG. 5 is an illustration of a stacker unit on which are multiple media sheets have been stored in accordance with one example; and FIGS. 6*a* and 6*b* are illustrations of a printing system according to further examples.

DETAILED DESCRIPTION

Being able to operate a printing system in a substantially unattended manner provides numerous advantages to printing system operators. One important enabler to allow substantially unattended operation is having a suitable print storage system.

Many printing systems store prints produced by the printing system in collection trays or stackers. These are typically complex mechanical devices that are designed to store prints of a predetermined size. Typically such trays or stackers are arranged in a horizontal manner and accordingly generally have a large footprint. Such print storage systems may not be suitable for storing prints of differing sizes. Print storage systems should also avoid causing damage to printed images.

Numerous examples will now be described that provide a print storage system suitable for storing a prints generated by a printing system in an automated manner. Examples described herein enable a large number of prints to be stored. Examples of the print storage system described herein additionally enable prints of different sizes to be stored, without requiring printing system operator intervention.

Referring now to FIG. 1, there is shown a simplified illustration of an example of printing system 100. FIG. 1*a* shows a side view of the printing system 100, whilst FIG. 1*b* shows a front view of the printing system 100. For clarity of explanation it will be understood that not all elements of a typical printing system are shown.

The printing system 100 comprises a base portion 102 supported by a stand 104. In some examples the base portion 102 may include elements such as media advance rollers, printing system electronics, print engine servicing elements, a printer platen, and the like. The printing system 100 additionally includes a printing system cover 106 that may be removable, pivotable, or slideable to enable a user to gain access to internal elements of the printing system 100.

The printing system 100 comprises a print engine 108 for creating images on a media. In one example the print engine 108 comprises one or multiple inkjet printheads for ejecting drops of liquid ink onto a media to produce a printed image on a media. In another example the print mechanism 108 may be a laser printing mechanism, and may generate dry or liquid ink marks on a media in a generally known manner. In a further example the print engine 108 may be a thermal printing mechanism which generates marks by selectively applying heat to a heat-sensitive media, again in a generally known manner.

In one example elements of the print engine 108 may scan along a print bar (not shown) of the printing system 100 in order to generate a printed swath along a width of a media. In another example elements of the print engine 108 may extend substantially along the width a media, for example in a page-wide array configuration, to generate a printed swath along a width of a media without the print engine 108 having to scan across the media.

In one example the printing system 100 generates prints in an incremental manner by advancing a media through the print engine 108 to enable multiple print swaths to be generated on the media.

Operation of the printing system 100 is controlled by a printing system controller 110. The controller 110 controls, for example, operation of the print mechanism 108 and media advance mechanisms (not shown) to enable prints to be produced. In one example the controller 110 may be a microprocessor or logic-based controller. In one example the controller 110 may be microprocessor in communication with a controller or computer readable memory (not shown) on which are stored controller or computer readable instructions that, when executed, cause the controller to perform method steps as described herein.

Media is ejected by the printing system 100 through a media output 112 on a front side 114 of the printing system 100. By front side is meant the side at which an operator generally interacts with the printing system. In the present example the media output 112 is formed by a gap between the cover 106 and the base 102.

The printing system 100 is arranged such that as media is progressively ejected through the media output 112, for example during performance of a printing operation, the media falls down under gravity and hangs substantially vertically from the media output 112 as indicated by arrow 116.

The printing system 100 further comprises a stacker unit 118 positioned below the level of the media output 112. Note that for clarity the stacker unit 118 is not shown in FIG. 1*b*. In one example the uppermost surface of the stacker unit 118 is positioned about 60 mm below the level of the media output 112, although in other examples the stacker unit 118 may be located at other positions. The stacker unit 118 is positioned in front of the main printing system 100 and distant therefrom to form a channel through which media ejected by the printing system 100 may pass. The distance between the stacker unit 118 and the printer base 102 may, in one example, be in the range of about 5 to 20 cm. In other examples, however, other distances may be used.

In one example, as shown in FIG. 1*a*, the stacker unit 118 is cylindrical bar that extends substantially along the width of the front side of the printing system 100. In one example the stacker unit 118 has a diameter in the range of about 2 to 30 cm, although in other examples the stacker unit 118 may have a different diameter. The stacker unit 118 may be connected to the printing system 100 in any suitable manner, for example by a pair of brackets each connected to one end of the stacker unit 118. In other examples the stacker unit 118 may take other shapes, such as a semi-cylindrical bar. The shape of the stacker unit 118 should be chosen, however, to avoid damaging a print stored thereon.

Located below the printer base 102 is a blower unit 120 that operates, under control of the controller 110, to switchably output an air stream towards the stacker unit 118. In one example the air stream output by the blower unit 120 is substantially horizontal. In another example the air stream output by the blower unit 120 is angled upwards at an angle between about 1 and 20 degrees. In other examples the air stream may be angled upwards at other angles.

A retainer unit 122 is located below the blower unit 120. The retainer unit 122 operates under control of the controller 110 to switchably generate a vacuum force or negative pressure towards the front face of the retainer unit 122. In one example the vacuum force is substantially horizontal. The vacuum force generated by the retainer unit 122 is sufficient to securely hold a portion of a media sheet as it is output from the media output 112 to prevent the leading edge of the media sheet from continuing to fall towards the ground under gravity as the media sheet continues to be ejected through the media output 112. In one example, the vacuum force generated by the retainer unit 122 may be adjustable based on media characteristics, such as the grammage or media density, surface friction, etc. of a media.

In one example the retainer unit 122 is located substantially at or below the level of the stacker unit 118.

As shown in FIG. 2*a*, in one example the blower unit 120 may comprise a linear array of fans or other air moving devices 202. As shown in FIG. 2*b*, in one example the retainer unit 122 may comprise a linear array of fans or other air moving devices 204. In one example the front face of the blower unit 120 and the retainer unit 122 comprise a grill to provide a substantially flat surface thereto, thereby preventing media from being damaged by fan blades.

Operation of the printing system 100 according to an example will now be described with reference to FIG. 3 and with further reference to FIGS. 4*a* to 4*d*.

At 302 the controller 110 obtains a print job describing an image to be printed on the printing system 100. The print job suitably contains all of the data needed by the printing system 100 to enable the image described in the print job to be successfully printed. The print job includes data that indicates the dimensions of the media sheet on which the printed image is to be printed, In one example the printing system 100 is configured to print on pre-cut media sheets which are stored in a suitable media tray (not shown). In one example the printing system 100 has multiple media trays (not shown) each containing different sizes of media sheets. The printing system 100 may, under control of the controller 110, determine which media sheet to print on based on data in the print job.

In a further example, the printing system 100 is configured to print on media on a continuous roll or web (not shown). In this example, the printing system 100 additionally includes a cutter (not shown) to cut the roll or media after a print job has been completed such that the finished print image is on a separate sheet of media of the appropriate size.

Figure 4A:
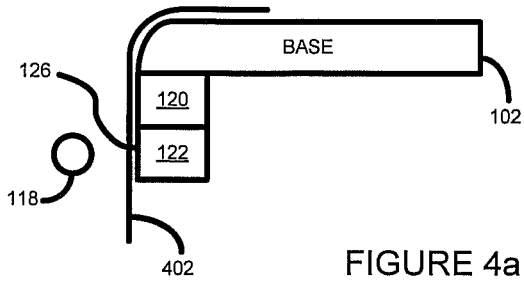

At 304 the controller 110 controls the printing system 100 to start printing the obtained print job. As the printing system 100 produces the printed image described in the print job the media on which the image is being printed is advanced through the print engine 106 and is ejected through the media output 112. As previously described, as media (402, FIG. 4*a*) is ejected out of the media output 112 the leading edge of the media 402 falls under gravity and passes through a channel defined between the stacker unit 118 and the printer base 102, as illustrated in FIG. 4*a*.

At step 306 the controller 110 determines when a pre-determined portion of the media 402 on which the print job is being printed is hanging below the uppermost level of the stacker unit 118.

In one example, the pre-determined portion may be about half of the length of the image described by the print job. In one example at least one of the diameter or width of the stacker unit 118, the position of the stacker unit 118, the position of the retainer unit 122, and the length of the media sheet may be taken into account when determining the pre-determined portion. As will be described below, the pre-determined portion is chosen such that a media sheet is stored on the stacker unit 118 in such a way that the media sheet hangs in substantial equilibrium.

As will be understood below, it is not necessary in all examples to determine with a high degree of accuracy when exactly half of the media is hanging below the uppermost level of the stacker unit 118.

The determination of when about half of the media is hanging below the uppermost level of the stacker unit 118 may be performed in a number of ways. In one example, the controller 110 uses signals or measurements from a media advance element, such as a media advance roller, to make the determination, based on the known position of the stacker unit relative to other elements of the printing system 100, such as the print engine 108. In another example the printing system 100 may include optical or other sensors to make the determination.

At 308, when the controller 110 has determined that about half of the media is hanging below the uppermost level of the stacker unit 118 it activates the retainer unit 122. Activation of the retainer unit 122 may, in one example, be achieved by sending an electrical or other control signal to a fan controller (not shown) to cause the or each fan in the retainer unit 122 to operate at a predetermined speed, or to provide a predetermined amount of negative pressure. In one example, the speed of the or each fan in the retainer unit 122 may be based on characteristics of the media, such as the dimensions media sheet defined in the print job, the type of media, etc.

The effect of activating the retainer unit 122 holds the portion of the ejected media 402 hanging in proximity to the retainer unit 122 against the front side of retainer unit 122. This prevents the leading edge of the ejected media 402 from further descending as more of the media 402 is ejected through the media output 112.

In one example, the front side of the retainer unit 122 may be covered in, or have applied thereto, a high-friction coating 126, such as a rubber compound, to improve retention of the media 402.

Figure 4B:
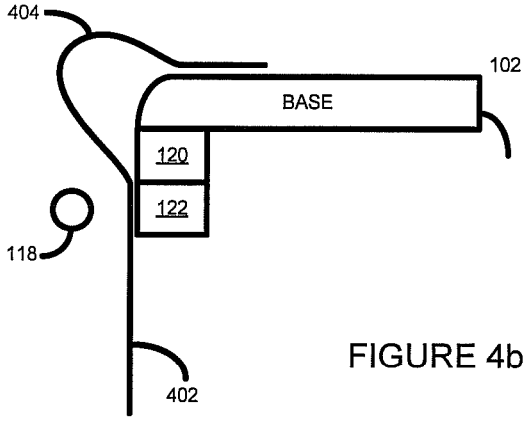

As more of the media 402 is ejected through the media output 112 as the printing of the print job continues a 'bubble' 404 of media forms, as illustrated in FIG. 4*b*.

When the printing system 100 has finished printing the print job (310) the controller 110 activates the blower unit 120 as the media 404 continues to be ejected through the media output 112.

In an example where the media 404 is part of a web of media and where the printing system 100 additionally includes a media cutter the controller 110 controls the media cutter to cut the media after the print job has been completed thereby creating a separate sheet of media.

Figure 4C:
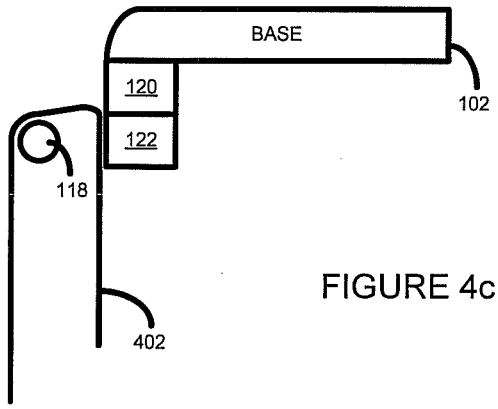

The force of the air stream output by the blower unit 120 onto a portion of the ejected media causes the trailing edge of the media sheet 402 to be blown over, or to flip over, the top of the stacker unit 118, as illustrated in FIG. 4*c*. The trailing edge of the media sheet 402 then hangs down over the stacker unit.

Once the flipping operation has been completed the controller 110 deactivates (314) the blower unit 120. In one example the controller 110 may determine that the flipping operation has completed once the blower unit 120 has been activated for a predetermined length of time. In one example the predetermined length of time may be between about 1 and 30 seconds. In other examples other lengths of time may be used. In a further example a detector, such as a light sensor, may be used to determine whether the media 402 has successfully flipped over the stacker unit 118.

Figure 4D:
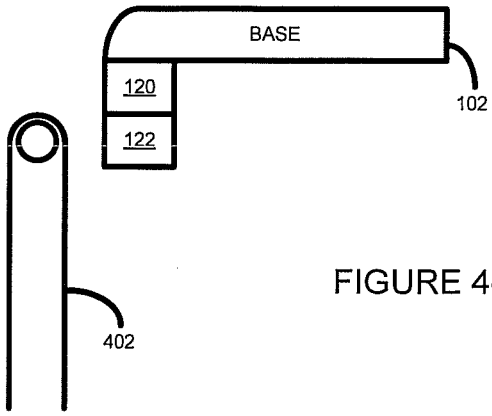

At 316 the controller 110 deactivates the retainer unit 122 enabling the ejected media sheet to hang substantially evenly and in equilibrium over the stacker unit 118, as shown in FIG. 4*d*.

Since an ejected media sheet hangs over the stacker unit 118 in equilibrium, this enables multiple prints to be stored on the stacker unit in the same manner, as illustrated in FIG. 5. As can be seen, multiple media sheets 402 may be stored on the stacker unit 118. Advantageously, media sheets of different sizes may be stored without problem, since each sheet hangs in equilibrium.

A further advantage provided by examples of the print storage system described herein is that a media sheet is stored on the stacker unit 118 in a manner that minimizes damage occurring to a printed image printed thereon. For example, the retainer unit 122 only contacts the underside (i.e. the non-printed side of the media 402). Furthermore, there is no rubbing or other attritional action applied to the printed image of a media sheet.

Furthermore, examples of the herein described print storage system enable a printing system to be operated in a largely unattended manner, even when prints of different sizes are being produced. Furthermore, the print storage system enables prints to be stored in a relatively small footprint. A yet further advantage is that the print storage system does not overly impede access to the front of the printing system. In a yet further example, the stacker unit 118 may be removable.

In a further example, where the retainer unit and blower unit comprise an array of fans or air moving elements, the controller 110 may be configured to only activate a sub-set of the those fans depending on the width of the media being printed on.

In another example, as illustrated in FIG. 6*a*, the stacker unit 118 may be replaced by a pair of spaced stacker units 118. In a yet further example, as illustrated in FIG. 6*b*, the stacker unit may be replaced by a stacker member 604 having a non-cylindrical shape.

It will be appreciated that examples of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A printing system comprising:

a media output through which a media sheet is ejected by the printing system;

a stacker unit to receive an ejected media sheet, the stacker unit positioned at or below a level of the media output and distant therefrom and forming a channel in which a portion of an ejected media sheet may pass;

a retainer unit located at or below a level of the stacker unit and controllable to exert a vacuum force on a portion of an ejected media sheet in proximity thereto; and a blower unit located above the retainer unit controllable to produce an air stream on a portion of an ejected media sheet to move a trailing edge thereof over the stacker unit.

2. The printing system of claim 1, further comprising a controller to:

control the printing system to start printing an image described in a print job;

determine when a pre-determined portion of an ejected media sheet is below the level of the stacker unit;

and when it is so determined:

activate the retainer unit;

complete printing the print job; and activate the blower unit to move the trailing edge of the ejected media sheet over the stacker unit.

3. The printing system of claim 2, wherein the controller is further to determine when a pre-determined portion of an ejected media sheet is below the level of the stacker unit based in part on at least one of a length of image to printed, a position of the stacker unit, a width of the stacker unit, and a position of the retainer unit.

4. The printing system of claim 2 wherein the controller is to activate the blower unit for a predetermined length of time to blow the trailing edge of the ejected media sheet over the stacker unit.

5. The printing system of claim 1, wherein the retainer unit comprises an array of fans controllable to produce a vacuum force or negative pressure to retain a portion of an ejected media sheet.

6. The printing system of claim 5, wherein the controller is to:

determine a width of a media sheet being printed on and to activate only a sub-set of the array of fans in the retainer unit based on the determined media sheet width.

7. The printing system of claim 5, wherein the controller controls the retainer unit to produce a vacuum force based on characteristics of the ejected media sheet.

8. The printing system of claim 1, wherein the blower unit comprises an array of fans controllable to produce an air stream on a media sheet in proximity thereto.

9. The printing system of claim 8, wherein the controller is to:

determine a width of a media sheet being printed on and to activate only a sub-set of the array of fans in the blower unit based on the determined media sheet width.

10. The printing system of claim 1, wherein an outer face of the retainer unit has a high-friction coating.

11. The printing system of claim 1, wherein the stacker unit is a cylindrical bar having a diameter of between about 2 to 30 cm.

12. The printing system of claim 1, wherein the stacker unit is removable.

13. A method of storing a media sheet ejected through a media output by a printing system the method comprising:

printing a print job on a media sheet;

determining that a predetermined portion of a media sheet, ejected by the printing system, is at or below a level of a stacker unit;

and upon determining that the predetermined portion of the media sheet is at or below the level of the stacker unit:

retaining a portion of the ejected media to prevent a leading edge thereof from advancing;

completing the print job; and blowing a trailing edge of the media sheet over the stacker unit.

14. The method of claim 13 wherein determining that a predetermined portion of a media sheet is at or below the level of a stacker unit is based on at least one of a length of media sheet on which the image is to be printed, a position of the stacker unit, a width of the stacker unit, and a position of the retainer unit.

15. The method of claim 13 wherein determining that a predetermined portion of a media sheet is at or below the level of a stacker unit includes determining that the trailing edge of a media sheet blown over the stacker unit hangs over the stacker unit substantially in equilibrium.

16. A controller readable medium on which are stored controller readable instructions that when executed by a controller perform the steps of:

commencing the printing of a print job on a media sheet;

determining when about half of the media sheet ejected out of a printer media output is at the level of a stacker unit;

activating a first array of fans to retain a portion of the ejected media sheet;

completing the print job; and activating a second array of fans to blow the trailing edge of the ejected media sheet over the stacker unit.

* * * * *